US009215911B1

(12) United States Patent
Carnley

(10) Patent No.: US 9,215,911 B1
(45) Date of Patent: Dec. 22, 2015

(54) BELT BUCKLE WITH STORAGE COMPARTMENT

(71) Applicant: Christopher W. Carnley, Pesnacola, FL (US)

(72) Inventor: Christopher W. Carnley, Pesnacola, FL (US)

( * ) Notice: Subject to any disclaimer, the term of this patent is extended or adjusted under 35 U.S.C. 154(b) by 378 days.

(21) Appl. No.: 13/974,873

(22) Filed: Aug. 23, 2013

(51) Int. Cl.
*A44B 11/00* (2006.01)

(52) U.S. Cl.
CPC ..... *A44B 11/005* (2013.01)

(58) Field of Classification Search
CPC ..... A44B 11/00; A44B 11/05; A44B 11/02; A44B 11/04; A44B 11/10; A44B 11/253; A44B 11/2523
See application file for complete search history.

(56) References Cited

U.S. PATENT DOCUMENTS

| | | | | | |
|---|---|---|---|---|---|
| 726,654 | A | | 4/1903 | Dodge | |
| 749,995 | A | | 1/1904 | Johnson | |
| 1,508,963 | A | | 9/1924 | Dorf | |
| 1,568,022 | A | | 12/1925 | Landrum | |
| 1,578,468 | A | | 3/1926 | Rankin | |
| 1,606,849 | A | | 11/1926 | Spear | |
| 1,753,765 | A | | 4/1930 | Withers | |
| 3,043,037 | A | | 7/1962 | Lesser et al. | |
| 3,148,426 | A | | 9/1964 | Lesser et al. | |
| D200,311 | S | | 2/1965 | Lesser et al. | |
| 3,927,442 | A | | 12/1975 | Foster | |
| D246,015 | S | | 10/1977 | Wayne et al. | |
| 4,113,157 | A | | 9/1978 | Woodbury | |
| 4,209,117 | A | * | 6/1980 | Corinaldi | A44B 11/005 206/37 |
| 4,260,087 | A | | 4/1981 | Leaver | |
| 4,384,390 | A | * | 5/1983 | Hayakawa | A44B 11/005 224/163 |
| 4,608,735 | A | * | 9/1986 | Kasai | A44B 11/10 24/171 |
| 4,753,377 | A | | 6/1988 | Poluhowich | |
| 4,805,820 | A | * | 2/1989 | Kearney | A61F 6/005 206/37 |
| 4,843,689 | A | * | 7/1989 | Fildan | A44B 11/006 24/198 |
| 4,903,378 | A | * | 2/1990 | Kasai | A44B 11/10 24/171 |
| 5,036,864 | A | * | 8/1991 | Yewer, Jr. | A41F 9/002 128/876 |
| 5,129,129 | A | * | 7/1992 | Collins | A44B 11/2576 24/579.11 |
| 5,311,653 | A | * | 5/1994 | Merrick | A44B 11/10 24/171 |
| 5,357,638 | A | | 10/1994 | Mayzel | |
| 5,446,441 | A | * | 8/1995 | Su | B62J 6/00 340/321 |
| 5,548,878 | A | * | 8/1996 | Romagnoli | A44B 11/258 24/168 |
| 5,577,300 | A | * | 11/1996 | Gutrugianios | A44B 11/12 24/170 |
| 5,615,459 | A | * | 4/1997 | Wu | A44B 11/14 24/170 |
| 5,687,890 | A | | 11/1997 | Wanner | |
| 5,871,129 | A | | 2/1999 | Boncompagni | |
| 6,665,913 | B2 | * | 12/2003 | Kosh | A44B 11/12 24/170 |
| 2007/0169783 | A1 | | 7/2007 | Santos | |
| 2008/0155793 | A1 | * | 7/2008 | Chen | A44B 11/02 24/191 |
| 2014/0208569 | A1 | * | 7/2014 | Rowland | A41F 9/025 29/428 |

* cited by examiner

*Primary Examiner* — Brian D Nash
(74) *Attorney, Agent, or Firm* — Peter Loffler

(57) ABSTRACT

A belt buckle with a storage compartment uses a typical box frame buckle architecture with a storage compartment hingedly attached to a back side of the box frame on a side opposite a grab bar of the box frame. The storage compartment articulates between a closed position against the box frame and an open position. In the closed position, a pin is removably received within a receiver in order to secure the compartment in the closed position. When the storage compartment is in the closed position, pivot posts that hold the grab bar are within the storage compartment and the grab bar partially overlays an open side of the storage compartment.

8 Claims, 5 Drawing Sheets

BELT BUCKLE WITH STORAGE COMPARTMENT

BACKGROUND OF THE INVENTION

1. Field of the Invention

The present invention relates to box-frame belt buckle with a rear positioned storage compartment for holding various items such as a magnesium block, flint, and striker for use during outdoor survival maneuvers.

2. Background of the Prior Art

When deep in the outdoors, whether on military exercises, hunting, or during survival maneuvers, certain items are essential. Among the many items that are needed to survive in the wilderness for an extended period of time, are tools that allow a fire to be started. A fire is indispensable to cook meals, possibly sterilize water, and provide warm and light. While matches and lighters are the fire starters of choice for many, each has certain drawbacks. Matches need to be kept dry in order to ignite and remain ignited for sufficient duration. Wet matches need a considerable length of time in order to dry out, if that is even possible, in order to become usable to start a fire. Similarly, if a lighter gets wet, the small flint, which tends to be somewhat internal to most lighters, also needs a considerable amount of time to dry out prior to becoming effective for its intended job. This means that care must be taken to keep such implements dry, which care is not always available during wilderness survival. Additionally, both matches and lighters, with their rather bulky fuel requirements, are essentially a finite resource.

As a result, many true survivalists rely on the ancient flint and striker method of fire starting wherein a strike material, such as a piece of steel such as the person's knife, is struck against a fire block, namely flint, onto a small pile of tinder, which may be produced using the steel blade by shaving of small bits off of a small magnesium block. The strike of the steel against the flint produces sparks, which ignite the tinder and thereby start a fire. This fire starting system takes little time to learn, and can be used in almost any conditions. If the flint becomes wet, the surface can be quickly dried in order to allow sparks to be generated therefrom. As the fire starting fuel is compact yet voluminous in its fire starting ability, the system does not run out of fuel in the way a lighter does. Flint, steel, and a magnesium block make the survivalist self-sufficient in terms of fire starting capability.

The next question for the survivalist is where to store the flint and magnesium block. While a camper can simply throw the items into his or her backpack without much thought, true wilderness survivalists travel light and do not have the storage luxuries of a typical camper or hiker. Some survivalists place the flint and magnesium block into their pants pockets. However, this valuable area of clothing real estate is often occupied by other necessities such as a compass or canteen. Additionally, as the flint and magnesium block tend to be very small, they can unknowingly fall out of their storage pocket when the survivalist retrieves another larger item from the same pocket.

What is needed is a storage system for storing a flint and magnesium block for a lean equipped wilderness survivalist which does not take up on-person storage real estate that is reserved for other needed items and which minimizes the risk that the flint and magnesium block will inadvertently become lost. Such a storage system must not hinder the survivalist in anyway and must be easy to utilize.

SUMMARY OF THE INVENTION

The belt buckle with storage compartment of the present invention addresses the aforementioned needs in the art by providing a storage system that conveniently holds a piece of flint and a magnesium block on the person of a wilderness survivalist who is relatively minimally loaded with needed equipment. The belt buckle with storage compartment, by utilizing the belt buckle of the pants of the user, allows other, more valuable clothing real estate of the user to be utilized for storing other required items such as a compass, canteen, etc. The belt buckle with storage compartment is designed to prevent inadvertent loss of its fire starting cargo and allows retrieval of the cargo from, and replacement of the cargo back into the storage compartment to be quick and easy so that such functions can be quickly performed even in adverse conditions. The belt buckle with storage compartment is of relatively simple design and construction being produced using standard manufacturing techniques.

The belt buckle with storage compartment of the present invention is comprised of a box frame that has a front, a back, a first side, a second side, a top and a bottom, and a lateral internal passage that receives a belt therethrough. A grab bar, having serrated teeth, is pivotally attached to the back of the box frame, proximate the first side in order to grabbingly secure one end of the belt. A slide post is slidably disposed within a first arcuate channel disposed within the top and a second coextensive arcuate channel disposed within the bottom in order to frictionally secure the belt portion that passes through the internal passage of the box frame. A storage compartment is hingedly attached to the back of the box frame proximate the second side. The storage compartment is capable of articulating between a closed position positioned against the back of the box frame and an open position. A closure means is attached to box frame and to the storage compartment for securing the storage compartment in the closed position, which closure means comprises a pin located on the box frame and a receiver located on the storage compartment (or vice versa) wherein the pin is removably receivable within the receiver. The pin may be threadably received within the receiver. The storage compartment has at least one open side. The grab bar is attached to the box frame via a pair of spaced apart pivot posts, one pivot post located proximate (just below) the top of the box frame, the other pivot post located proximate (just above) the bottom of the box frame, such that the pivot posts are located within the storage compartment whenever the storage compartment is in the closed position such that the grab bar partially covers the open side of the storage compartment.

BRIEF DESCRIPTION OF THE DRAWINGS

Similar reference numerals refer to similar parts throughout the several views of the drawings.

DESCRIPTION OF THE PREFERRED EMBODIMENT

Figure 1:
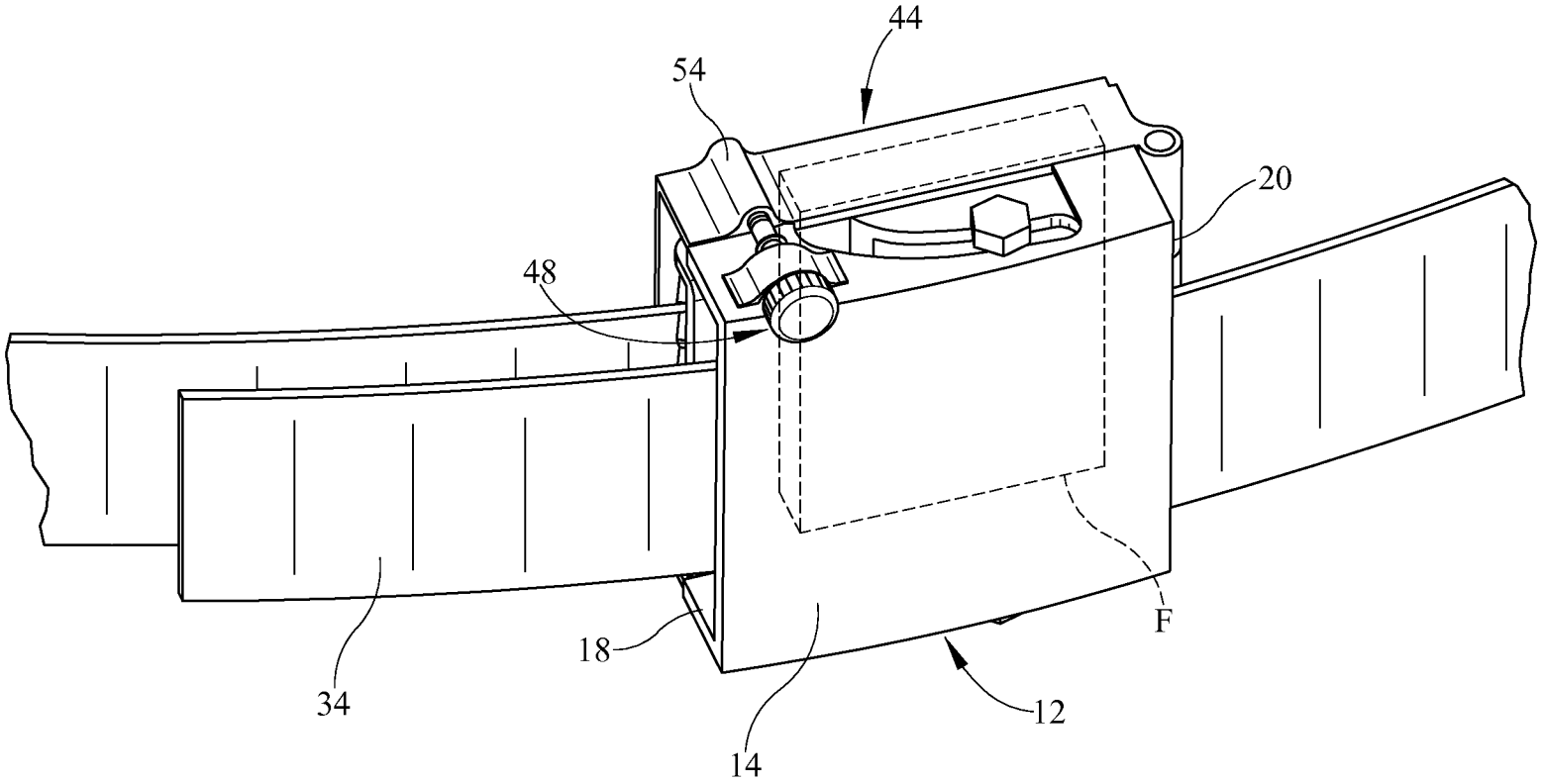
FIG. 1 is a perspective view of the belt buckle with storage compartment of the present invention installed on a belt.

Referring now to the drawings, it is seen that the belt buckle with storage compartment of the present invention, generally denoted by reference numeral 10, is comprised of a typical box-frame buckle that has a box-shaped body member 12 with a front 14, a back 16, a first side 18, a second side 20, a top 22 and a bottom 24 with a lateral internal passage 26 through the body member 12. A grab bar 28 is pivotally attached to the back 16 of the body member 12 at the first side 18, between the top 22 and the bottom 24 between two pivot posts 30. Each pivot post 30 is offset from its respective top 22 or bottom 24 of the body member 12. The grab bar 28 is a typical grab bar that has a row or serrated teeth 32 thereon such that one end of the belt 34 positioned between the two pivot posts 30 and between the grab bar 28 and the body member 12 and the grab bar 28 is rotated so that the teeth 32 of the grab bar 28 dig into the belt 34 and thereby secure this first end of the belt 34 to the belt buckle with storage compartment 10. The opposing end of the belt 34 is passed through the internal passage 26 of the body member 12, through the second side 20, the end of the belt 34 being pulled out of the internal passage 26 through the first side 18. The belt 34 is size adjusted about the user and a slide post 36 that is slidably disposed in a pair of parallel arcuate channels 38, one channel 38 located within the top 22 of the body member 12, the other channel 38 located within the bottom 24 of the body member 12, is slid from proximate the front 14 of the body member 12 toward a post receiver 40 located on the back 16 of the body member 12 in order to frictionally engage the belt 34 and secured the belt 34 in its user desired sized position within the body member 12. Post heads 42 located on the top and bottom of the slide post 36 prevent the slide post 36 from falling out of the channels 38.

Figure 2:
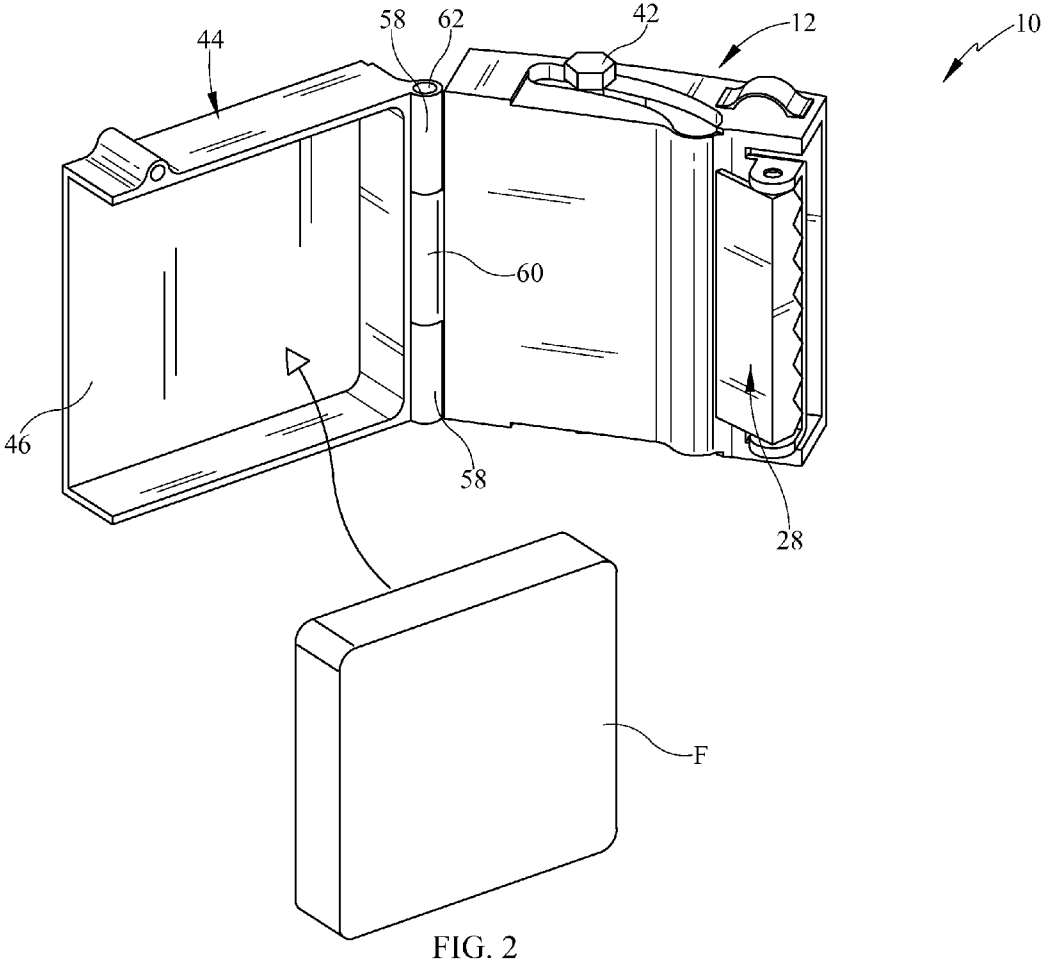
FIG. 2 is a perspective view of the belt buckle with storage compartment with the storage compartment open.
Figure 3:
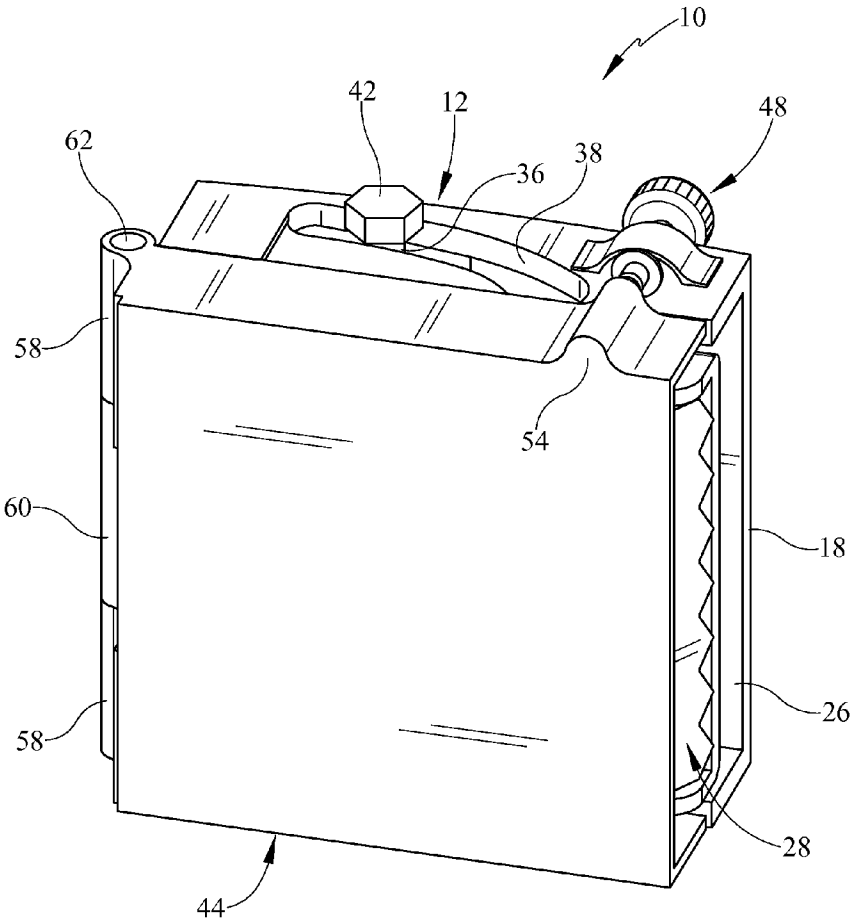
FIG. 3 is a perspective view of the belt buckle with storage compartment in a closed configuration.
Figure 4:
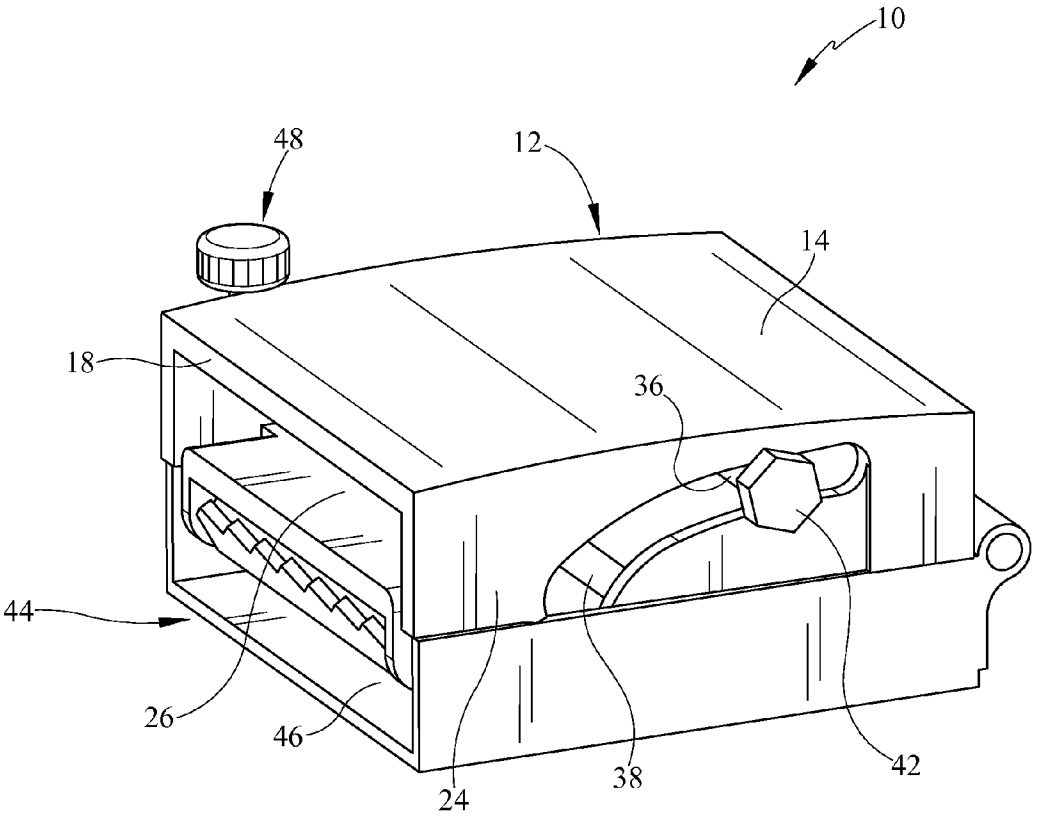
FIG. 4 is a rotated perspective view of the belt buckle with storage compartment in a closed configuration.
Figure 5:
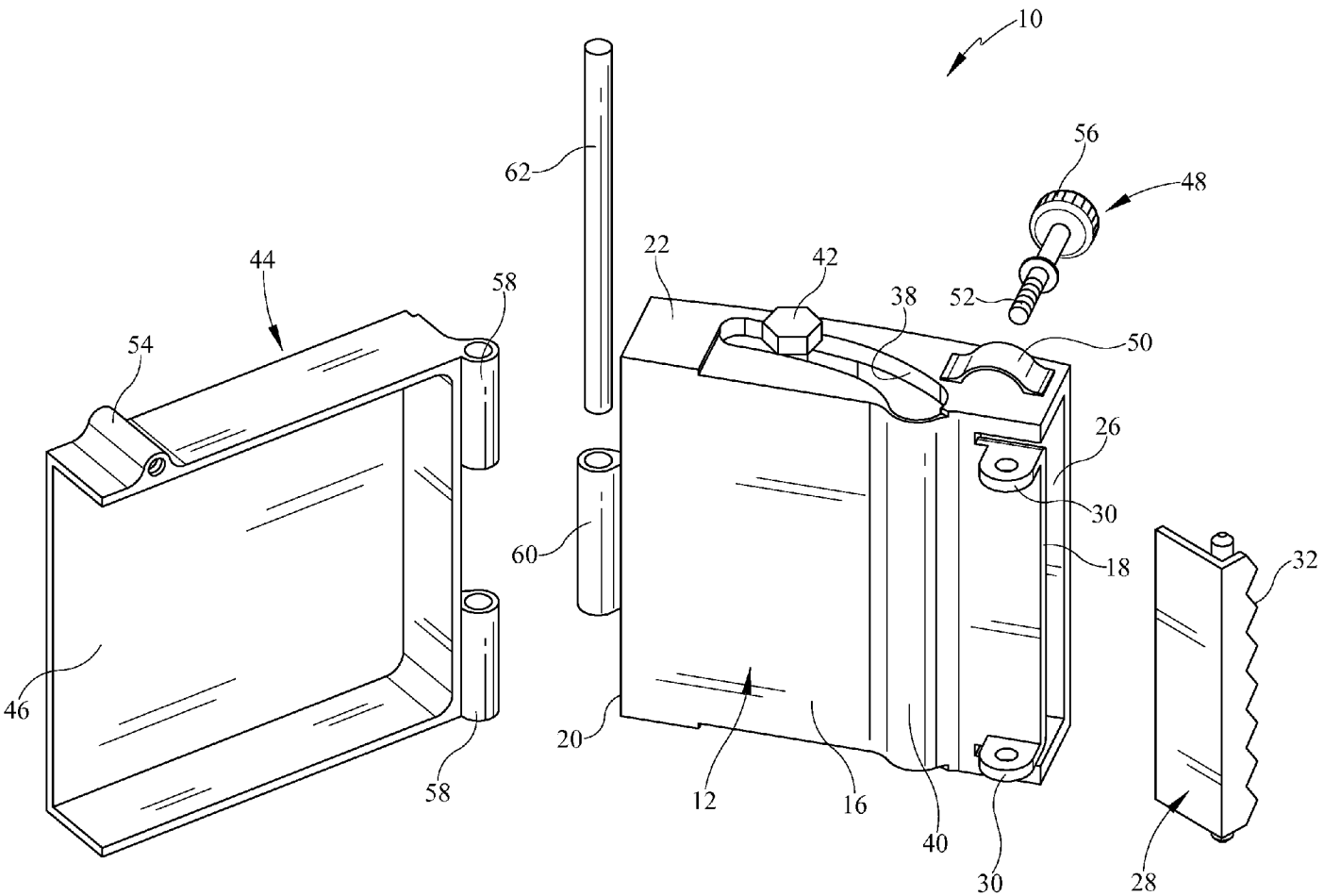
FIG. 5 is a partially exploded perspective view of the belt buckle with storage compartment.

A storage compartment 44 is hingedly attached to the back 16 of the body member 12 at the second side 20 and has at least one open side 46. The storage compartment 44 hingedly articulates between an open position, as best seen in FIG. 2, allowing access into the storage compartment 44, and a closed position, as best seen in FIGS. 1, 3 and 4, wherein the storage compartment 44 is closed and its contents F are secured therein. In the closed position, the back 24 of the body member 12 acts as one of the walls of the storage compartment 44. Additionally, the open side 46 of the storage compartment 44 is located at the first side 18 of the body member 12. As the pivot posts 30 are offset from both the top 22 and bottom 24 of the body member 12, the storage compartment 44 straddles the pivot posts 30 so that the pivot posts 30 are within the storage compartment 44. The grab bar 28 extending between these posts 30, partially covers the open side 46 of the storage compartment 44 and helps secure its cargo F therein.

A closure pin 48 is secured to a pin holder 50 located on the top 22 of the body member proximate the first side 18 thereof. The end 52 of the closure pin 48 is threadably received within a pin receiver 54 located on a top of the storage compartment 44 in order to secure the storage compartment 44 in its closed position against the body member 12—it being expressly recognized that the closure pin can have means other than threadable attachment to secure the closure pin within the pin receiver, such as by being frictionally received therein, or can has a spring ball on the closure pin's distal end, etc. The closure pin 48 has appropriate means (not illustrated) to prevent the closure pin 48 from being expelled from the pin holder 50. The head 56 of the closure pin 48 can be knurled or otherwise textured for easy grasping of the closure pin 48.

In order to use the belt buckle with storage compartment 10 of the present invention, the belt 34 is secured to the body member 12 in the usual way. The storage compartment 44 is opened by removing the closure pin 48 from the pin receiver 54 and swinging the storage compartment 44 open. Desired cargo F is placed into the storage compartment 44 and the storage compartment 44 is swung closed against the body member 12. The closure pin 48 is appropriately secured to the pin receiver 54 in order to close the storage compartment 44. The user wears the belt 34 in the usual way. When access to the cargo F within the storage compartment 44 is required, the closure pin 48 is removed from the pin receiver 54, the storage compartment 44 is swung open, and the cargo F removed as needed. Obviously, during storage compartment access 44, the user may need to loosen or even partially remove the belt 34 from about his or her body.

The various components of the body member 12 as well as the storage compartment 44 including the closure pin 48 as well as the hinge knuckle(s) 58 on the storage compartment 44 (these hinge knuckles 58 may be monolithic with the storage compartment 44), the hinge knuckle(s) 60 on the body member 12 (these hinge knuckles 60 may be monolithic with the body member 12), and the hinge pin 62, are all made from an appropriate sturdy material, such as aluminum or steel, or can even be made from a hard plastic, etc.

While the invention has been particularly shown and described with reference to an embodiment thereof, it will be appreciated by those skilled in the art that various changes in form and detail may be made without departing from the spirit and scope of the invention.

I claim:

1. A belt buckle comprising:

a box frame having a front, a back, a first side, a second side, a top and a bottom, and a lateral internal passage;

a grab bar having serrated teeth, pivotally attached to the back of the box frame, proximate the first side;

a slide post slidably disposed within a first arcuate channel disposed within the top of the box frame and a second coextensive arcuate channel disposed within the bottom of the box frame; and a storage compartment hingedly attached to the back of the box frame proximate the second side, the storage compartment capable of articulating between a closed position positioned against the back of the box frame and an open position.

2. The belt buckle as in claim 1 further comprising closure means attached to box frame and to the storage compartment for securing the storage compartment in the closed position.

3. The belt buckle as in claim 2 wherein the closure means comprises:

a pin located on the box frame; and a receiver located on the storage compartment wherein the pin is removably receivable within the receiver.

4. The belt buckle as in claim 3 wherein the pin is threadably received within the receiver.

5. The belt buckle as in claim 4 wherein the storage compartment has at least one open side.

6. The storage compartment as in claim 5 wherein the grab bar is attached box frame via a pair of spaced apart pivot posts, one pivot post located proximate the top of the box frame, the other pivot post located proximate the bottom of the box frame, such that the pivot posts are located within the storage compartment whenever the storage compartment is in the closed position such that the grab bar partially covers the open side of the storage compartment.

7. The belt buckle as in claim 1 wherein the storage compartment has at least one open side.

8. The storage compartment as in claim 7 wherein the grab bar is attached box frame via a pair of spaced apart pivot posts, one pivot post located proximate the top of the box frame, the other pivot post located proximate the bottom of the box frame, such that the pivot posts are located within the storage compartment whenever the storage compartment is in the closed position such that the grab bar partially covers the open side of the storage compartment.

* * * * *